US005349791A

United States Patent [19]

Zaleski

[11] Patent Number: 5,349,791

[45] Date of Patent: Sep. 27, 1994

[54] SNOW GUARD AND ITS APPLICATION

[76] Inventor: Joseph D. Zaleski, 49 Rservoir Rd., Farmington, Conn. 06032

[21] Appl. No.: 85,586

[22] Filed: Jun. 30, 1993

[51] Int. Cl.[5] ..... E04D 13/00

[52] U.S. Cl. ..... 52/24; 52/746

[58] Field of Search ..... 52/24, 25, 26, 746; 156/313, 749

[56] References Cited

U.S. PATENT DOCUMENTS 2,599,359 6/1957 Banks et al. ..... 156/313

5,228,248 7/1993 Haddock ..... 52/545

FOREIGN PATENT DOCUMENTS 384952 7/1990 European Pat. Off. ..... 52/24

*Primary Examiner*—Carl D. Friedman

*Assistant Examiner*—Creighton Smith

*Attorney, Agent, or Firm*—McCormick, Paulding & Huber

[57] ABSTRACT

A flat base for a roof mounted snow guard is provided with a foam filled adhesive strip to facilitate attachment of the snow guard to a smooth metal roof. The adhesive strip preferably has approximately five square inches of bonded area for this purpose and the thickness of the strip is preferably one millimeter at least 0.04 inches.

2 Claims, 1 Drawing Sheet

SNOW GUARD AND ITS APPLICATION

BACKGROUND OF THE INVENTION

This invention relates generally to snow guards of the type applied to a roof structure, particularly to a metal roof structure, and deals more particularly with an improved snow guard construction that greatly facilitates the application of the snow guard to such a metal roof structure.

DETAILED DESCRIPTION

Figure 1:
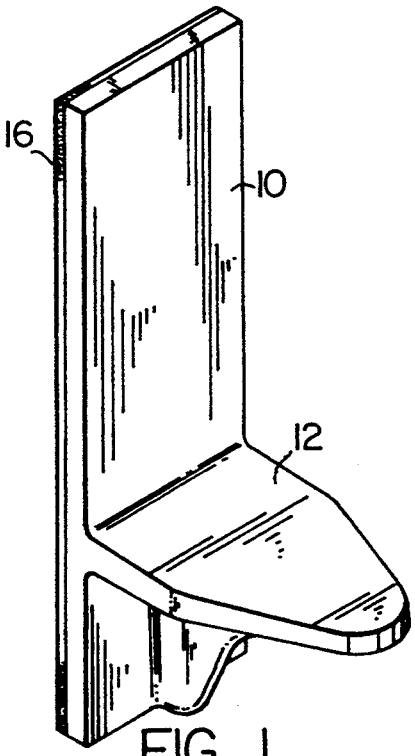
FIG. 1 shows a cast or molded snow guard constructed in accordance with the present invention.
Figure 3:
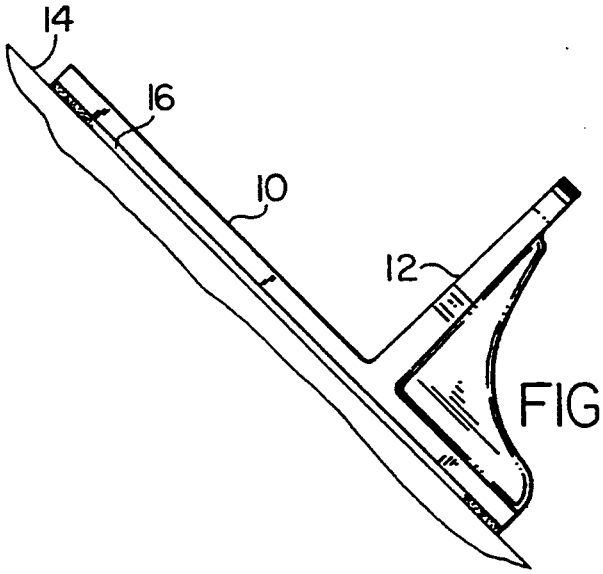
FIG. 3 is a view illustrating the snow guard applied to a roof surface.

Turning now to the drawings in greater detail, a typical snow guard is shown in FIG. 1 having an elongated base 10 and having an upstanding shelf portion 12 integrally formed with the base for purposes of impeding the downward movement of snow on a sloping roof structure. The base 10 is adapted to be secured to a roof structure 14 (See FIG. 3) and several such snow guards are generally provided in certain areas of the roof structure, typically the area above a door or other access opening in the building where the danger of snow descending onto persons could otherwise pose a dangerous situation in areas where snow falls are such that means must be provided for preventing the snow from sliding off such a roof structure.

Some roof structures, typically those fabricated of metal such a aluminum or copper, pose a particularly serious hazard since any slight warming of the roof structure will result in such an unpredictable sliding of snow therefrom.

The purpose of the present invention is to provide a roof guard that is uniquely suited for attachment to such metal roofs without the need for fasteners or the application of messy adhesives applied from a gun or the like.

The snow guard shown, and more particularly the base portion 10 thereof, has a layer 16 of very high bond (VHB) adhesive applied to the backside of the base, and a backing strip 18 is provided on the exposed adhesive layer so as to protect the adhesive layer 18 during shipment and storage prior to application of the snow guard to a roof structure.

In its presently preferred form the very high bond adhesive layer 16 comprises and acrylic foam tape of the type sold by 3M under their Scotch Brand VHB trademark.

The preferred thickness for the adhesive layer 16 is preferably on the order of one millimeter or 0.04 inches, and this thickness affords maximum benefits when a device of the type illustrated in the drawings is applied to a metal roof structure.

I presently prefer the 3M product of this general type sold under the Scotch Brand Model designation No. 4932 or 4952. Such an adhesive impregnated acrylic foam tape has excellent adhesion as between metals and other so-called "low surface energy" materials.

In accordance with the method of the present invention a snow guard is provided with a flat backside, and the snow guard is preferably fabricated from aluminium or bronze depending upon the metal surface to which it will be applied. Like metals will expand and contract correspondingly, and therefore will afford better long term adherence. A plastic molded material may also be used on metal or other surfaces if the tape material is of proper specification.

The backside of the base portion of the snow guard is provided with an area of at least four square inches, and preferably at least five square inches, so that the very high bond adhesive of the type described hereinabove will have sufficient working area. The adhesive should have a thickness on the order of 0.04 inches (or one millimeter) to afford maximum adhesion as between the metal snow guard and the metal roof structure. These dimensions have been found to lead to optimum results.

Figure 2:
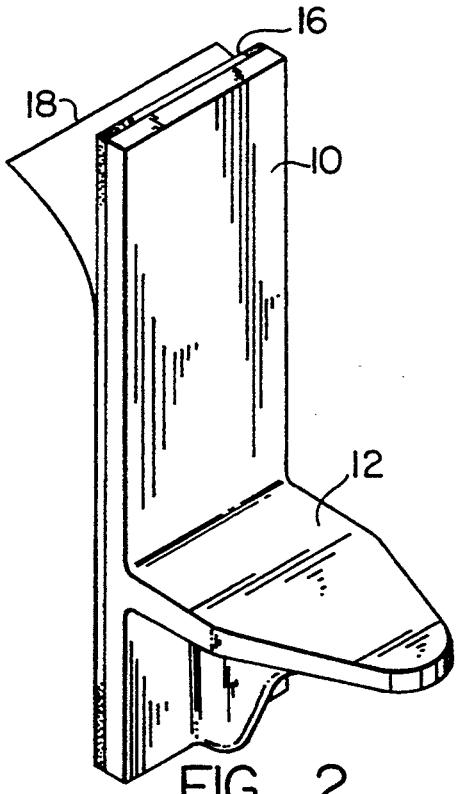
FIG. 2 is a view of the snow guard illustrated in FIG. 1 with the backing being peeled away from the adhesive layer provided on the backside thereof.

A backing material 18 is provided on the exposed surface of the very high bond adhesive tape material, which backing material 18 is removed upon assembly of the snow guard with the roof structure (See FIG. 2). At assembly the snow guard is pressed onto the roof structure such that the exposed adhesive will adhere to the underlying metal roof structure (See FIG. 3). Some preliminary cleaning of the metal roof structure may be required so as to remove any oxidation in the event that the roof structure has been exposed to the hostility of the environment for any significant length of time between the time it is erected and the time when the snow guard is applied.

I claim:

1. A snow guard for use on a metal roof, and comprising a cast metal base with upstanding shelf and a backside of at least four square inches, said base backside being flat, a layer of 0.04 inch thick acrylic foam tape one side of which tape is adhesively applied to said base backside, said foam tape having an exposed surface coextensive with said one side, and a peel-off backing material covering said exposed tape surface until the snow guard is to be applied to a metal roof or the like.

2. The method comprising casting a metal snow guard with a flat backside and with an upstanding shelf on its front side, applying a layer of 0.04 inch thick acrylic foam tape to said snow guard backside, and providing a peel-off backing material to the exposed surface of said foam tape for protection, peeling off the protective backing material, and applying the exposed surface of the foam tape to a metal roof without the need for mechanical fasteners or other attachments.

* * * * *